United States Patent [19]

Rieur

[11] 3,986,293

[45] Oct. 19, 1976

[54] BUILDING ELEMENTS CONTAINER UNIT

[76] Inventor: Renan Rieur, 10 Terrace Ave., Riverside, Conn. 06878

[22] Filed: Dec. 3, 1971

[21] Appl. No.: 204,630

[52] U.S. Cl. ..... 46/16
[51] Int. Cl.[2] ..... A63H 33/10
[58] Field of Search ..... 46/11, 16, 17

[56] References Cited

UNITED STATES PATENTS

| | | | |
|---|---|---|---|
| 1,092,591 | 4/1914 | Pajeau | 46/16 |
| 1,982,834 | 12/1934 | Smith et al. | 46/17 |
| 3,410,021 | 11/1968 | Patterson | 46/16 X |

FOREIGN PATENTS OR APPLICATIONS

| | | | |
|---|---|---|---|
| 969,980 | 6/1950 | France | 46/16 |
| 22,072 | 2/1902 | United Kingdom | 46/11 |

*Primary Examiner*—F. Barry Shay
*Attorney, Agent, or Firm*—George W. Rauchfuss, Jr.; Anthony J. Castorina

[57] ABSTRACT

The invention relates to a set of building elements and features a container constructed therefrom and adapted to receive, transport and store compactly the building elements. More particularly this invention relates to a set of building elements that are basically multiples of one another and when portions thereof are assembled together on a base unit form a container unit adapted to receive the remaining elements and thereby form a substantially rectangular unit of assembled elements which are easily stored and transported.

5 Claims, 8 Drawing Figures

FIG. 1
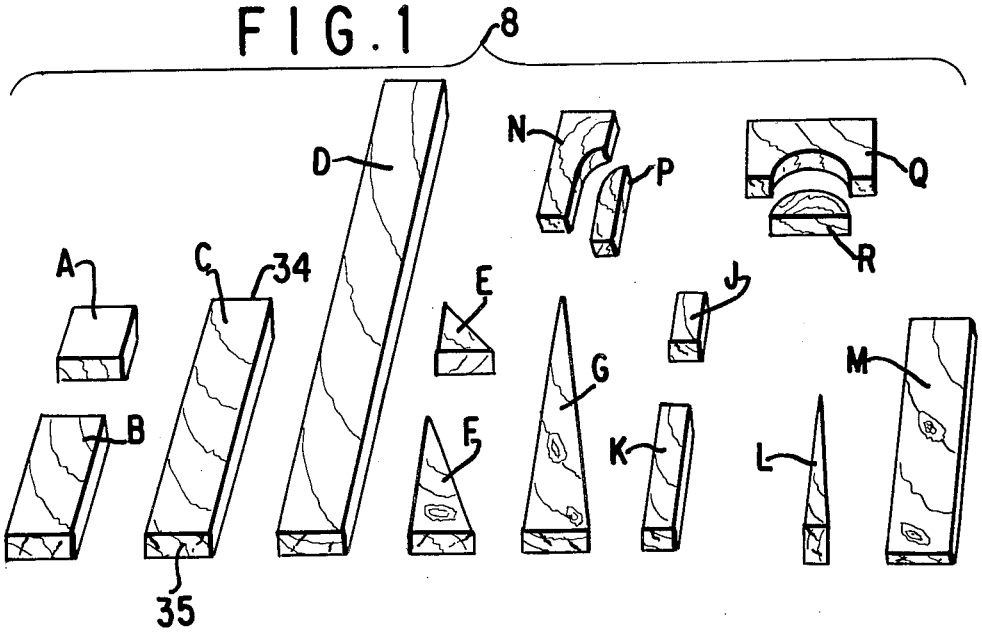
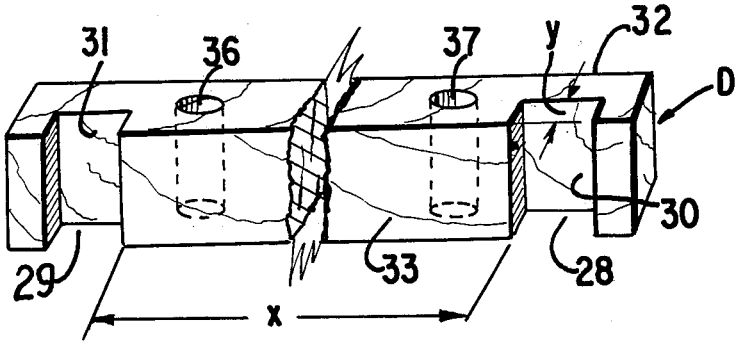
FIG. 2
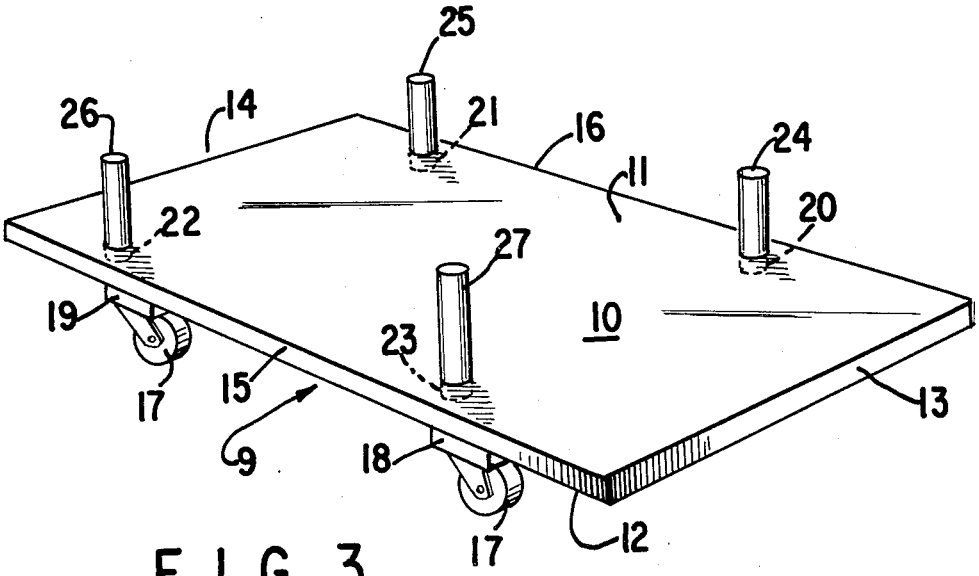
FIG. 3

FIG. 4
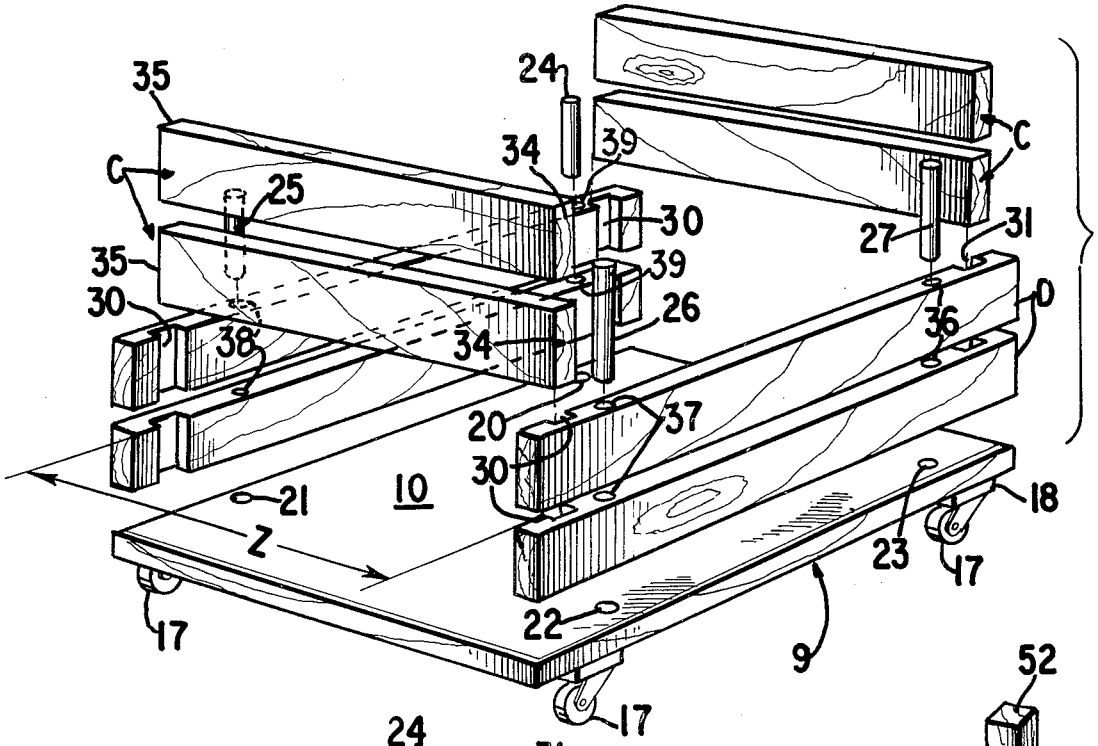
FIG. 5
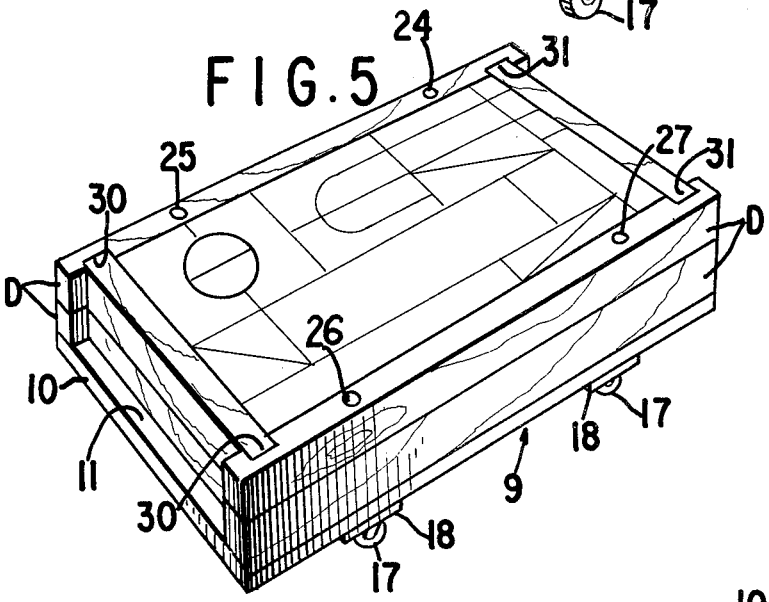
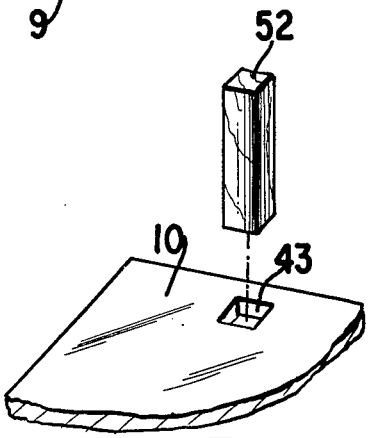
FIG. 6a
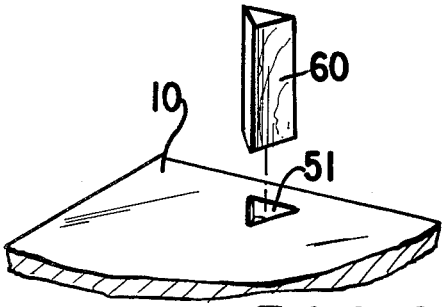
FIG. 6c
FIG. 6b
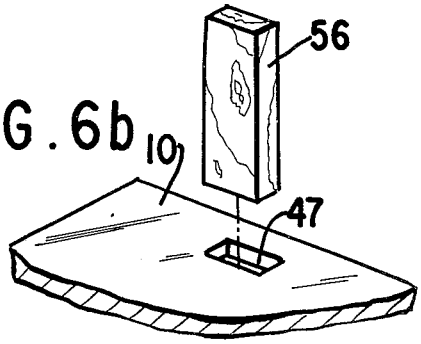

BUILDING ELEMENTS CONTAINER UNIT

FIELD OF INVENTION

The present invention relates to a novel toy comprising a novel set of building blocks and a storage container therefor.

DISCUSSION OF PRIOR ART

Heretofore building block sets have either not come with their own long lasting storage container or the container itself is not a part of the building elements and lacks any further usefulness other than as a storage container. An example of this latter type of building blocks is found in U.S. Pat. No. 3,410,021 issued Nov. 12, 1968 to John L. Patterson. The container disclosed therein is a hinged rectangular box and is not composed of the building elements itself.

BACKGROUND OF INVENTION

A great many of the toys presently available are of only limited usefulness. As an example, building blocks which children use in constructive playtime are generally useful only for the limited purpose of constructing structures such as houses, castles, ranches, ramps and the like. While this limited usefulness is suitable for stimulating a child's creative imagination and teaching him sizes, shapes and configurations, once the child is through playing with the building blocks then they generally must be stored in a separate toy chest or other suitable container. This is not always desirable since the storage chest or container may not always be nearby or the chest may be filled with other toys. In addition when a child wants to later retrieve the building blocks from the toy chest for use again he must go through an all out search to separate them from the other toys. Even then he generally is not sure that he has retrieved all the building elements until he goes to use them and finds an element missing. Moreover, it is generally not convenient to move the toy chest from one location to another since it is usually too heavy to do so and would involve moving many toys with which the child does not wish to play.

It is therefor an object of this invention to provide a set of building elements which may be assembled together on a base unit and thereby form a container for receipt, compact storage and transport of the remainder of the building elements which together form a generally rectangular unit completely filling the storage container.

Another object of this invention is to provide a plurality of building elements which can be assembled in a container for the remaining building elements without the need of conventional fasteners or adhesives.

Yet another object of this invention is to provide a plurality of building elements which may be assembled to provide a sturdy and durable storage container for the remaining building elements.

A still further object of this invention is to provide a simple storage container for building elements which is so constructed as to be readily and easily assembled, disassembled and reassembled.

A further additional object of this invention is to provide a toy of building elements which in addition to all the above advantages will also be inexpensive to manufacture and be in compact form for shipping purposes.

These together with other advantages which will become apparent reside in the details of construction as more fully hereinafter described.

DETAILS OF INVENTION

This invention relates to a set of building elements which are assembled together on a base unit and which thereby form a container unit for receipt, compact storage and transport of the remainder of the building elements which together form a generally rectangular unit completely filling the storage container unit. The details of this invention are more fully understood by reference being had to the accompanying drawings forming a part hereof wherein like numerals and letters refer to like parts throughout and in which FIG. 1 is a perspective view of the various building elements commonly found in a generally available set of building elements.

FIG. 2 is a perspective view of a modified form of one of the building elements.

FIG. 3 is a perspective view of the base unit of the present invention.

FIG. 4 is an exploded perspective view of the assembled container unit of the present invention.

FIG. 5 is another perspective view of the assembled container unit of the present invention when filled with the remaining building elements.

FIGS. 6A, 6B, and 6C are other partial perspective views of modified forms of the base unit of the present invention.

Referring now in more detail to the drawings, and more particularly to the building elements depicted in FIG. 1, a typical set of building elements is disclosed and represented generally by the reference numeral 8. To be generally attractive and interesting to children in order to stimulate their creative imagination a typical set of building elements will generally be made up of a plurality of various size and shape building elements. Among the varied sizes and shapes of building elements constituting a set of building elements there may be a square A, an oblong B which is the size of two squares laid side by side, a doublong C which is the size of two oblongs laid end to end lengthwise, a quadlong D which is the size of two doublongs laid end to end lengthwise, a diagonal E which is half of a square when cut in half from opposite corners on the same face, a triangle F which is half of an oblong when cut in half from opposite corners on the same face, a double unit triangle G which is half of a doublong when cut in half from opposite corners on the same face, a half pillar J which is one half a square, a pillar K which is one half an oblong, a ramp L which is half an oblong when cut diagonally from a corner on one face to the opposite corner on the opposite face of the oblong, a roof board M which is one-third a doublong when cut in thirds heightwise, an arch N and a buttress P which are cut from and thus fit together to form an oblong, and a Roman arch Q and half-circle R which also are cut from and thus fit together to form an oblong. Of course these are only some of the various elements that may form the common building element set and other configurations will be readily evident. Any configuration of building elements is within the contemplation of the invention when it can be employed with the remainder of the building element configurations to form a rectangular block of building elements as more particularly shown and described hereinafter in connection with FIG. 5.

There is shown in FIG. 3 a base unit 9 for use in connection with the container unit of this invention. The base unit depicted in FIG. 3 although representing a preferred form of the invention is merely exemplary of the type of base unit that may be employed. As examples of other representative base units that may be employed in connection with the invention reference may be had to the base units disclosed in FIGS. 6A, 6B and 6C. The base unit comprises a flat panel member 10 comprised of a planar top support surface 11 and a planar bottom support surface 12, the two surfaces 11 and 12 being separated by two transverse planar opposite end walls 13 and 14 and a pair of longitudinally extending planar opposite side walls 15 and 16. Attached to the bottom support surface 12 is a plurality of transport means 17, generally casters and preferably swivel casters, to provide mobility to the unit. Although, as shown in FIG. 3, four caster elements will generally be so attached to the bottom support surface 12 any suitable number of caster elements sufficient to provide both stability and mobility to the base unit may be employed, such as for example, three or more such caster elements. The caster elements 17 may be attached to the bottom support surface 12 by any suitable means of attachment but generally and most preferably by screws (not shown). The caster elements 17 may be attached directly to the surface of the bottom support surface 12, but preferably are attached to an additional brace units 18 and 19 which are then attached to the bottom support surface 12. In addition to the bulk and weight of the base unit 9 being reduced by the use of said brace units 18 and 19 the brace units are of use in adding additional stability to the container unit of the invention as will be more fully explained hereinafter.

The flat panel member 10 is provided with a plurality of recesses, depicted by arcuate recesses 20, 21, 22 and 23, at the periphery of two opposite sides 15 and 16 of said flat panel member 10. Although the exemplified embodiment shows the recesses placed on the longer of the opposite sides it will be appreciated that the recesses could also be placed on the shorter of the pair of opposite sides, that is, along sides 13 and 14. Generally two recesses on each side will be sufficient although more than two recesses may be employed if desired. Also the recesses are generally arcuate although any suitable shaped recess may be employed, such as for example, a square, rectangular or triangular recess such as in FIGS. 6A, 6B or 6C respectively by recesses 43, 47, and 51. The recesses are adapted to receive a plurality of elongated shafts 24, 25, 26 and 27 which serve as support elements for the sides of the container unit. The elongated shafts are of the same configuration as the recesses 20, 21, 22 and 23 and therefore are generally cylindrical as shown in FIG. 3 although they may be square, rectangular or triangular as shown in FIGS. 6A, 6B and 6C as shafts 52, 56 and 60 respectively.

The sides of the container unit are formed from the building element forming a part of the set of building blocks. The longest sides of the container unit are formed from the longest rectangular building elements to be included as a part of the set of building blocks. For example, where the building element set is composed of those elements shown in FIG. 1 the longest sides would be formed from the quadlong element D, while the shorter sides of the container unit would be formed from any suitable shorter rectangular building elements included within the set of building elements which in the case of the set shown in FIG. 1 the doublong element C would be suitable.

Only slight modification of these building elements is required to produce the container unit of the present invention. In the embodiment shown the longer sides of the container unit are formed from quadlongs D modified in the manner shown in the FIG. 2. A quadlong D is provided with a pair of grooves 28 and 29 of rectangular cross-section, uniform throughout the length of each groove to provide inner walls 30 and 31 within the grooves extending parallel to the surfaces 32 and 33 of the rectangular quadlong element D for engaging and positioning end surfaces 34 and 35 of the short side rectangular block elements C. The spaced apart grooves 29 and 28 are located at opposite ends of the inner surface 33 of the rectangular block. The position of the grooves 28 and 29 are such that the space $x$ on the surface 33 of the block between the two grooves 28 and 29 is a multiple of the basic building elements unit. The depth $y$ of the grooves 28 and 29 is such that when the short side rectangular block elements C are placed in the grooves 28 and 29 the distance $z$ between the two longer sides D of the container unit is also a multiple of the basic building element unit. The width of the grooves 28 and 29 is slightly greater than the thickness of the end blocks C to allow the end blocks to fit snugly therein.

Each of the longer side elements D of the container are also provided with a plurality of chambers 36, 37, 38 and 39 located at a position on the elements D immediately above recesses 20, 21, 22 and 23 in the base unit. These chambers are of the same shape as the recessess and thus may be circular, square, rectangular, triangular or the like but are preferably circular. The chambers 36, 37, 38, and 39 extend completely through the width of element D and are each adapted to receive a complementary shaped shaft depicted as cylindrical shafts 24, 25, 26 and 27. Chambers 36, 37, 38, and 39 and recesses 20, 21, 22 and 23 may be of any convenient size, all equally sized. Elongated shafts 24, 25, 26 and 27 will be approximately equal to the size of the recesses and chambers but slightly smaller so that the shafts may be received in the chambers and recesses to allow interconnection of the elements.

Reference may be had to FIG. 4 wherein a completed container unit of the invention is depicted. A base unit 9 constructed as previously described with supporting casters has a plurality of shafts 24, 25, 26 and 27 placed on recesses 20, 21, 22 and 23 located on the opposing long sides of the base unit. Rectangular elements D are then placed on the periphery of the long sides of the base unit by slipping shafts 24, 25, 26 and 27 through the chambers 36, 37, 38 and 39 located in said elements D. The opposing shorter sides of the base unit which are comprised of identical units C are then formed by placing the shorter elements C in the opposing grooves 28 and 29 respectively. The heights of shafts 24, 25, 26 and 27 is such as to enable one or more such units of sides to be layered thereon. A preferable arrangement is such as to provide for two such layers of sides as just described. It will be appreciated however that the shaft heights can be of any convenient length to provide just one layer of sides or a plurality of layers of sides Recesses 20, 21, 22 and 23 are of a depth in the base unit to provide sturdiness and stability to the shafts situated therein. Preferably the base units are provided with the brace supports 18 and 19 located directly below the recesses 20, 21, 22 and 23 and the recesses may then extend a part of the way, or all the way, through the brace supports 18 and 19. Preferably the recesses extend all the way through the brace supports 18 and 19 and thus the shafts rest on the caster units attached to the base unit 9 directly below the recesses.

A base container unit so constructed can then be filled with the remaining building elements to provide a substantially rectangular unit. For example if the building elements set is composed of those parts shown in FIG. 1 a set of 13 squares, 14 oblongs, two doublongs, six diagonals, six pillars, six half-pillars, six roof boards, two arches, two Roman arches, six triangles, four ramps, two half-circles, two buttresses and two double triangles may be arranged and stored in the container unit forming a substantially rectangular unit. Other combinations of such elements are equally suitable and are within the contemplation of this invention. All the parts of the container unit are to be considered parts of the building element set and may be employed in by the child in his imaginative creations. For example, the shafts may be used as columns in buildings.

The building elements of this invention are constructed of any suitable material from which children's building blocks may be fabricated, such as, for example, a hardwood or a softwood material or any suitable plastic, such as polystyrene or the like. Most preferably the material is a hard wood such as birch. Other hardwoods that may be used are maple and beech.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention as claimed.

What is claimed as new is as follows:

1. A container unit for a set of building blocks in which the container unit is formed from component parts of the set of building blocks which comprises a rectangular planar base support member having a top and a bottom planar surface separated by two transverse opposite end walls and two longitudinally extending planar opposite side walls, a plurality of recesses being located at the periphery of said two opposing side walls and on the top planar surface of said base support, said planar base support member supporting upwardly extending opposing side and end members said side members being of rectangular block construction having a pair of rectangular grooves at opposite ends of the inward face thereof and extending from top to bottom thereof, a plurality of chambers extending through the side members from top to bottom, each of said chambers being positioned above one of said recesses in the base support member so as to be adapted to receive an elongated shaft therein in a manner such that the shaft is also received in one of said recesses of said planar base support member, upwardly extending elongated shafts being located within said recesses and said chambers, the end members being of rectangular block construction and received in said opposing grooves on said opposing side members, the confined space thus formed by the side and end members is such that both the distance between the two grooves on opposite ends of the same side member and the distance between the inner faces of the opposing side members is a multiple of the basic building block unit whereby the container unit is adapted to receive the remaining building block elements therein to form a generally rectangular self-contained unit.

2. A container unit of claim 1 wherein the end and side members are formed by a plurality of rectangular block members placed at the periphery of the base support and supported by the upwardly extending elongated shafts.

3. The container unit of claim 1 wherein the recesses in the base support member, the chambers in the side members and the shafts received in said recesses and chambers are circular.

4. The container unit of claim 3 wherein the base support member has a plurality of transport means attached on the under side of said support member to provide mobility to said unit.

5. A set of building blocks comprising in combination the container unit of claim 1 and a set of building elements, said building elements dimensioned to be received in said container as a unit of generally rectangular form completely filling the container unit.

* * * * *